US007204316B2

(12) United States Patent
Dusterhoft et al.

(10) Patent No.: US 7,204,316 B2
(45) Date of Patent: Apr. 17, 2007

(54) EXPANDABLE WELL SCREEN HAVING TEMPORARY SEALING SUBSTANCE

(75) Inventors: Ronald G. Dusterhoft, Katy, TX (US); Bradley L. Todd, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 159 days.

(21) Appl. No.: 10/760,649

(22) Filed: Jan. 20, 2004

(65) Prior Publication Data

US 2005/0155772 A1 Jul. 21, 2005

(51) Int. Cl.
*E21B 43/10* (2006.01)

(52) U.S. Cl. ..... 166/381; 166/207; 166/227

(58) Field of Classification Search ..... 166/296, 166/276, 376, 227, 228, 236, 230, 381, 207, 166/229; 137/627, 637
See application file for complete search history.

(56) References Cited

U.S. PATENT DOCUMENTS

| | | | | |
|---|---|---|---|---|
| 1,229,437 | A * | 6/1917 | Foster | 210/458 |
| 2,224,630 | A | 12/1940 | Dean et al. | |
| 2,401,035 | A | 5/1946 | Akeyson et al. | |
| 2,981,332 | A | 4/1961 | Miller et al. | |
| 2,981,333 | A * | 4/1961 | Miller et al. | 166/276 |
| 3,099,318 | A | 7/1963 | Miller et al. | |
| 3,216,497 | A | 11/1965 | Howard et al. | |
| 3,333,635 | A * | 8/1967 | Crawford | 166/276 |
| 3,361,203 | A | 1/1968 | Rensvold | |
| 3,880,233 | A | 4/1975 | Muecke et al | |
| 3,999,608 | A | 12/1976 | Smith | |
| 4,185,652 | A * | 1/1980 | Zintz et al. | 137/78.2 |
| 4,202,411 | A | 5/1980 | Sharp et al. | |
| 5,062,484 | A | 11/1991 | Schroeder, Jr. et al. | |
| 5,234,055 | A | 8/1993 | Cornett | |
| 5,287,923 | A | 2/1994 | Comette et al. | |
| 5,310,000 | A | 5/1994 | Arterbury et al. | |
| 5,320,178 | A | 6/1994 | Comette | |
| 5,829,520 | A | 11/1998 | Johnson | |
| 6,263,972 | B1 | 7/2001 | Richard et al. | |
| 6,394,185 | B1 * | 5/2002 | Constien | 166/296 |
| 6,412,565 | B1 * | 7/2002 | Castano-Mears | 166/381 |
| 6,523,611 | B1 | 2/2003 | Bakker et al. | |
| 6,543,545 | B1 * | 4/2003 | Chatterji et al. | 166/381 |

(Continued)

FOREIGN PATENT DOCUMENTS

| | | |
|---|---|---|
| GB | 2316024 | 2/1998 |

(Continued)

OTHER PUBLICATIONS

International Search Report for PCT/US2005/000801.

(Continued)

*Primary Examiner*—Kenneth Thompson
(74) *Attorney, Agent, or Firm*—Marlin R. Smith

(57) ABSTRACT

An expandable well screen having a temporary sealing substance. In a described embodiment, a method of installing a well screen in a subterranean well includes the steps of: providing the screen including a temporary sealing substance preventing fluid flow through a wall of the screen; positioning the screen in a wellbore of the well; expanding the screen in the wellbore; and degrading the sealing substance, thereby permitting fluid flow through the screen wall.

31 Claims, 4 Drawing Sheets

U.S. PATENT DOCUMENTS

| | | | |
|---|---|---|---|
| 6,599,863 | B1 | 7/2003 | Palmer et al. |
| 2002/0142919 | A1 | 10/2002 | Constien |
| 2003/0060374 | A1 | 3/2003 | Cooke, Jr. |
| 2004/0040723 | A1 | 3/2004 | Hovem |
| 2004/0055747 | A1 | 3/2004 | Lee |

FOREIGN PATENT DOCUMENTS

| | | |
|---|---|---|
| WO | WO 2005/012689 | 2/2005 |

OTHER PUBLICATIONS

U.S. Appl. No. 10/609,031, filed Jun. 27, 2003.
Baker Hughes sales information "catEXX™ System Expansion Method", undated.
Halliburton Energy Services, Inc. literature, "Expandable Sand Screen Technology Offers Improved Completion Efficiency and Reliability", dated 2003.
Enventure literature, "SET™ Technology: The Facts", dated 2003.

* cited by examiner

EXPANDABLE WELL SCREEN HAVING TEMPORARY SEALING SUBSTANCE

BACKGROUND

The present invention relates generally to equipment utilized and operations performed in conjunction with a subterranean well and, in an embodiment described herein, more particularly provides an expandable well screen having a temporary sealing substance.

It is desirable to be able to circulate through a well screen while installing the screen in a well. In the past, such circulation has been provided by a washpipe extending through the screen. The washpipe permits fluid to be circulated through the screen before, during and after the screen is conveyed into the well, without-allowing debris, mud, etc. to clog the screen.

Expandable screens have been used in the past, either with or without the use of a washpipe. When the washpipe is used, a separate trip into the well is typically needed to expand the screen after the washpipe is removed from the screen. When the washpipe is not used, there is no sealed path available in the screen assembly to allow fluids to be pumped from the top of the screen to the bottom. As a result, any attempts to circulate fluid in the well would result in large volumes of fluid being pumped through the screen media, potentially plugging or clogging the screen.

Therefore, it may be seen that improved methods and systems are needed to permit circulation through an expandable well screen during its installation in a well, while not requiring an additional trip into the well to expand the screen. Other benefits could also be provided by improved methods and systems for installing well screens in a well.

SUMMARY

In carrying out the principles of the present invention, in accordance with an embodiment thereof, systems and methods are provided for installing well screens in a well. A temporary sealing substance is used to prevent fluid flow through a wall of an expandable screen during the installation process. Preferably, the screen is conveyed into the well and expanded in a single trip into the well.

In one aspect of the invention, a method of installing a well screen in a subterranean well is provided. The method includes the steps of: providing the screen including a temporary sealing substance preventing fluid flow through a wall of the screen; positioning the screen in a wellbore of the well; expanding the screen in the wellbore; and degrading the sealing substance, thereby permitting fluid flow through the screen wall.

In another aspect of the invention, a method of installing a well screen in a subterranean well includes the steps of: providing the screen including a temporary sealing substance preventing fluid flow through a wall of the screen; conveying the screen into a wellbore of the well while the sealing substance prevents fluid flow through the screen wall; expanding the screen in the wellbore; and degrading the sealing substance, thereby permitting fluid flow through the screen wall.

In yet another aspect of the invention, an expandable well screen system is provided. The system includes a well screen having a filtering layer for filtering well fluid as the fluid flows through a wall of the screen. A temporary sealing substance prevents the fluid from flowing through the screen wall. The screen has an expanded configuration and an unexpanded configuration in a well.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
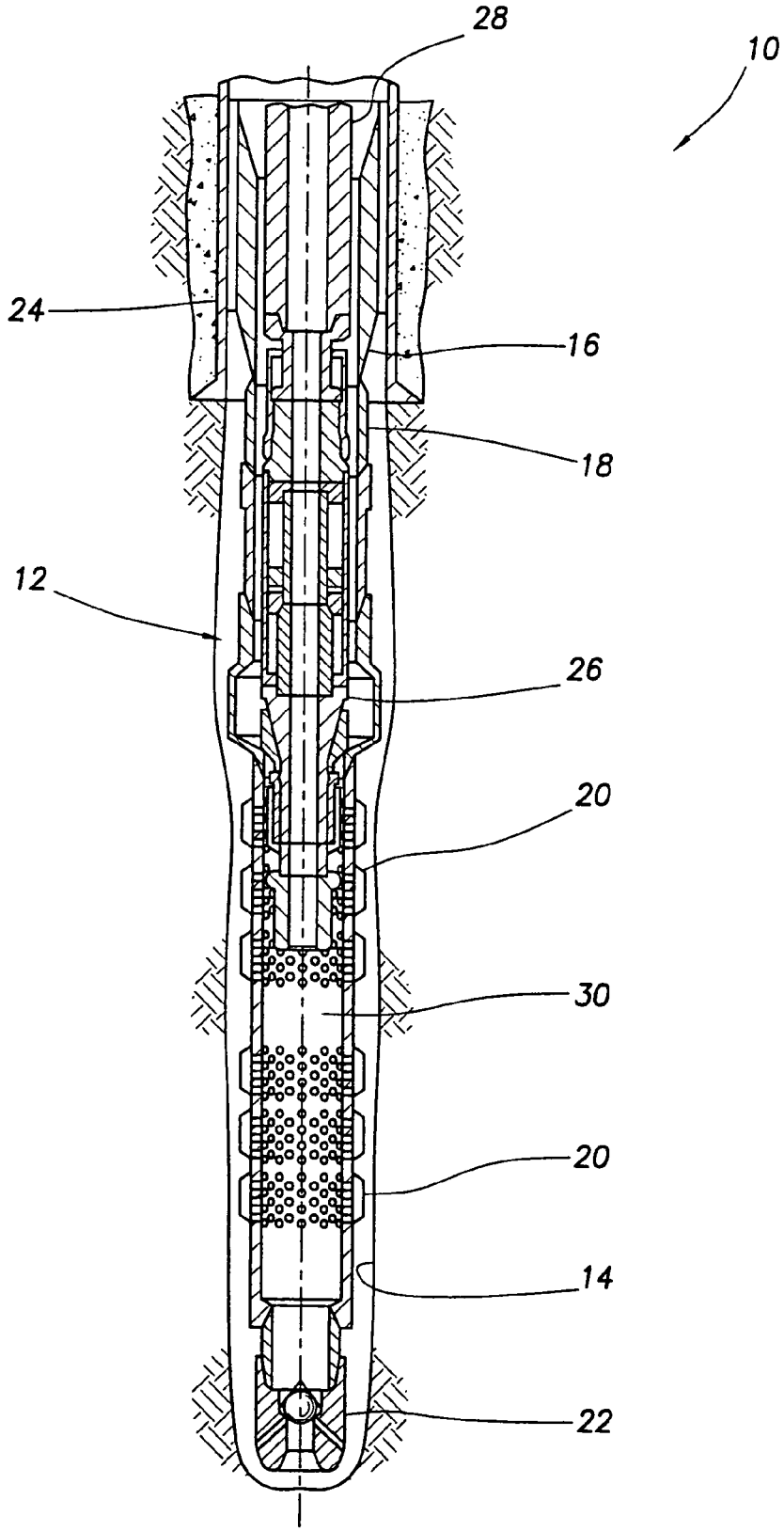
FIG. 1 is a schematic cross-sectional view of a well screen installation system embodying principles of the present invention.

Representatively illustrated in FIG. 1 is a system 10 which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, a well screen assembly 12 is conveyed into a wellbore 14. The assembly 12 includes an expandable hanger 16, a fluid loss control device 18, expandable screens 20 and a one-way valve 22. The screens 20 are conveyed into an open hole portion of the wellbore 14, while the hanger 16 is set in casing 24 above. However, it should be clearly understood that the principles of the invention are not limited to any particular details of the system 10 described herein. For example, any number of the screens 20 could be used, the screens could be positioned in a cased portion of the wellbore 14, more, less or different tools, equipment, etc. could be included in the assembly 12, etc.

The assembly 12 is preferably conveyed into the wellbore 14 with an expander tool 26 attached thereto. This permits the assembly 12 to be conveyed into, and expanded in, the wellbore 14 in a single trip into the well. The assembly 12 and expander tool 26 may be conveyed by means of a tubular string 28, such as drill pipe or production tubing, or any other type of conveyance.

During installation of the assembly 12, it is beneficial to be able to circulate through the assembly, including circulating through a passage 30 formed longitudinally through the screens 20. For example, debris in the wellbore 14 may be displaced by circulating if problems are encountered in conveying the screens 20 into the uncased wellbore portion, specialized fluid pills may be spotted in the wellbore as needed (such as, to remediate a fluid loss problem), an appropriate completion fluid may be circulated into the wellbore prior to expansion of the screens, etc. The one-way valve 22 (such as a float shoe or float collar) prevents fluid circulated down through the passage 30 and into the wellbore 14 from flowing back into the interior of the screens 20.

To provide this circulation capability, and also to prevent solids from clogging the screens 20 during installation, a sealing substance 32 (not visible in FIG. 1) is used to prevent fluid flow through sidewalls of the screens. The sealing substance 32 provides the function of a washpipe, without requiring an additional trip into the well to remove the washpipe and install the expander tool 26.

Figure 2:
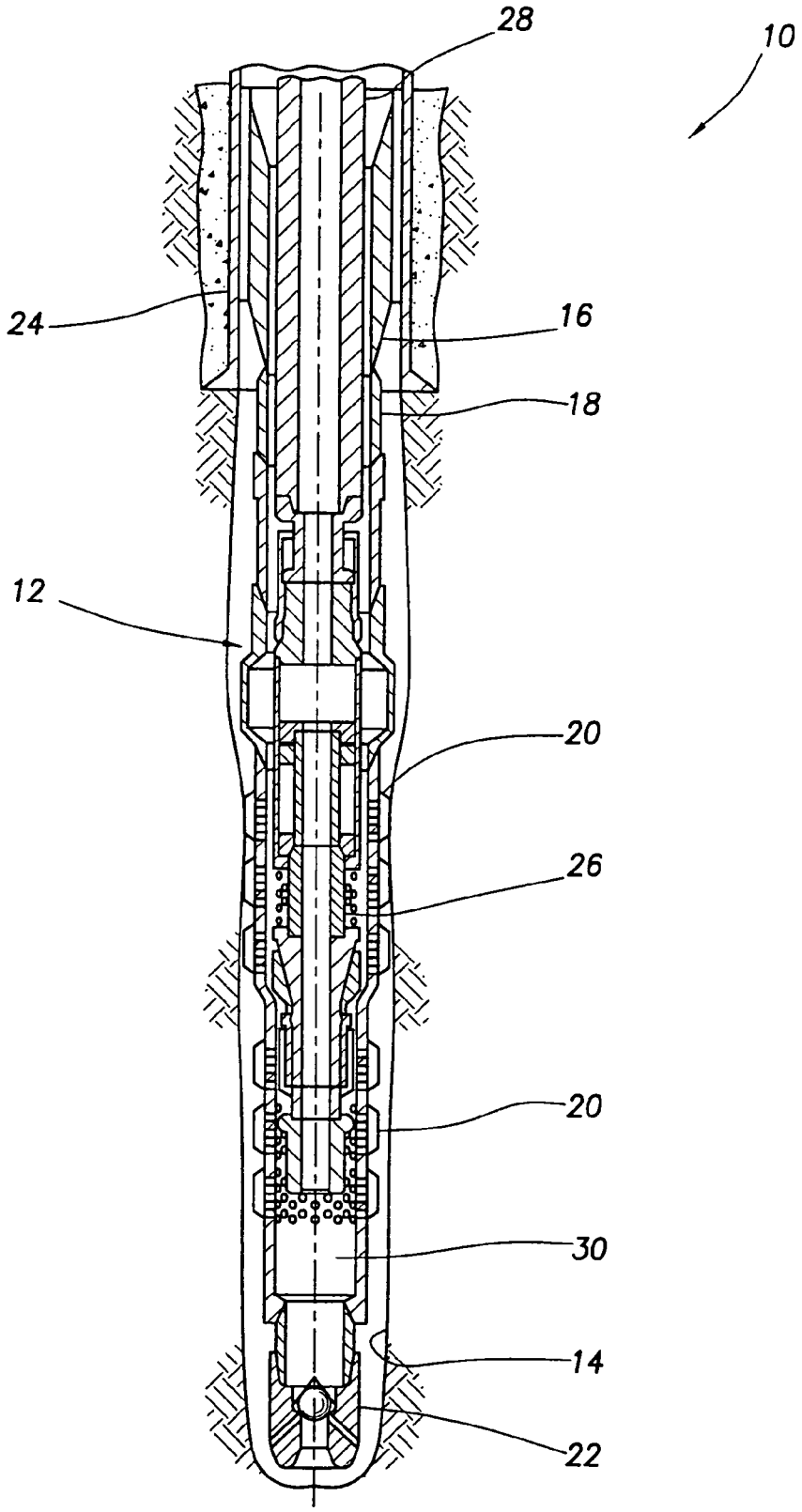
FIG. 2 is a schematic cross-sectional view of the system of FIG. 1, wherein a well screen is being expanded in a well.

As depicted in FIG. 1, the liner hanger 16 has been set in the casing 24. Referring additionally now to FIG. 2, the expander tool 26 is being used to expand the screens 20 in the wellbore 14. The same expander tool 26 may have previously been used to expand the hanger 16 (as depicted in FIG. 1), or another tool may be used if desired. An acceptable expander tool for use in the system 10 is available from Halliburton Energy Services, Inc. of Houston, Tex.

Figure 3:
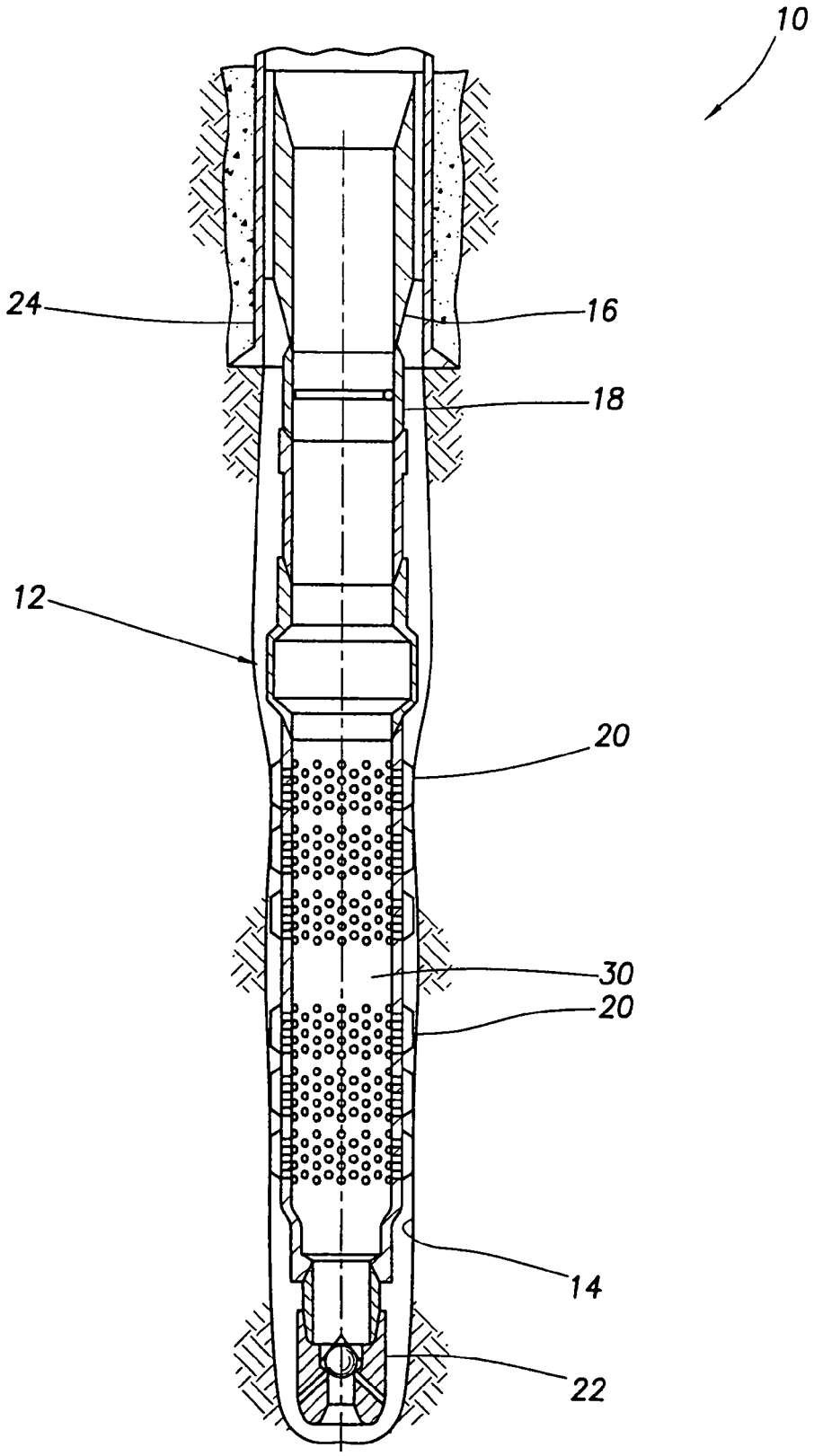
FIG. 3 is a schematic cross-sectional view of the system of FIG. 1, wherein a screen installation process has been completed.

Referring additionally now to FIG. 3, the screens 20 have all been expanded, and the expander tool 26 has been retrieved from the well, along with the tubular string 28. Note that only a single trip into the well is required to convey the screen assembly 12, position the assembly in the wellbore 14, set the hanger 16 and expand the screens 20. This is accomplished in the system 10 while also providing the ability to circulate through the assembly 12 during the installation.

The fluid loss control device 18 is closed as depicted in FIG. 3, in order to prevent loss of well fluid after the tubular string 28 and expander tool 26 are retrieved. An acceptable fluid loss control device is the Quick Trip Valve available from Halliburton Energy Services, Inc. of Houston, Tex.

Figure 4:
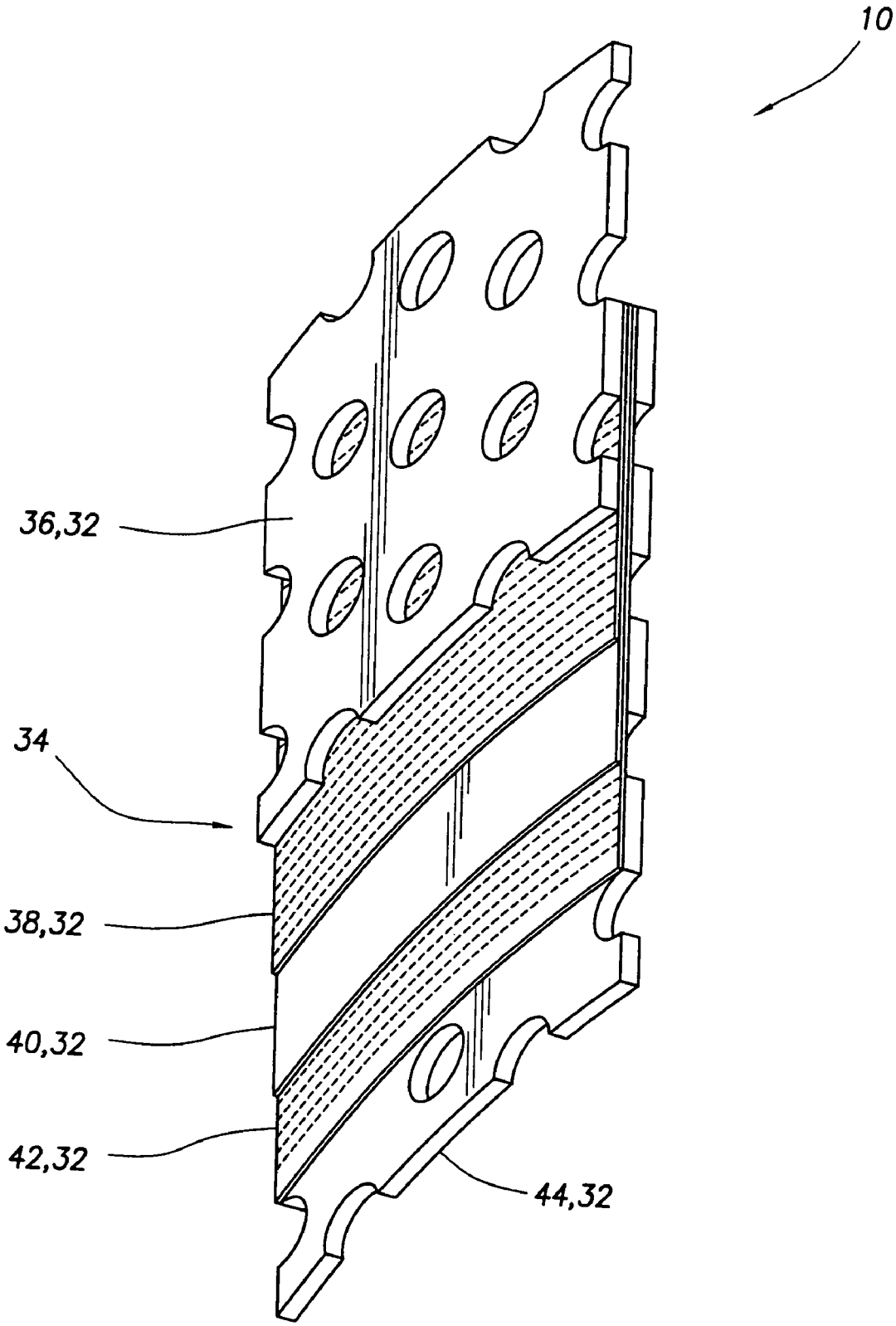
FIG. 4 is an isometric view of a wall of the screen used in the system of FIG. 1.

Referring additionally now to FIG. 4, an enlarged view of a sidewall 34 of one of the screens 20 is representatively illustrated, apart from the remainder of the screen. The screen sidewall 34 includes a perforated tubular outer shroud 36, an outer relatively coarse wire mesh drainage layer 38, a relatively fine wire mesh filtering layer 40, an inner relatively coarse wire mesh drainage layer 42, and a tubular perforated inner base pipe 44. The filtering layer 40 is sandwiched between the drainage layers 38, 42, and these are positioned between the outer shroud 36 and the base pipe 44.

Preferably, at least the filtering layer 40 has the sealing substance 32 therein, for example, by impregnating the filtering layer with the sealing substance, so that the sealing substance fills voids in the filtering layer. However, any of the other layers 38, 42, shroud 36 or base pipe 44 could have the sealing substance 32 applied thereto, in keeping with the principles of the invention. For example, the sealing substance 32 could block fluid flow through the perforations in the shroud 36 or base pipe 44, or the sealing substance could be impregnated in the wire mesh of the drainage layers 38, 42, or any combination of the above.

Preferably, the sealing substance 32 is degradable when exposed to a subterranean well environment. More preferably, the sealing substance 32 degrades when exposed to water at an elevated temperature in a well. Most preferably, the sealing substance 32 is provided as described in copending U.S. patent application Ser. No. 10/609,031, filed Jun. 27, 2003, the entire disclosure of which is incorporated herein by this reference.

The sealing substance 32 may be a degradable polymer, such as one or more of a polysaccharide, chitin, chitosan, protein, aliphatic polyester, poly(actide), poly(glycolide), poly(ϵ-caprolactone), poly(hydroxybutyrate), poly(anhydride), aliphatic polycarbonate, poly(orthoester), poly (amino acid), poly(ethylene oxide), or a polyphosphazene. The sealing substance 32 may include a plasticizer, poly (lactic acid), a poly(lactide), or poly(phenyllactide).

The sealing substance 32 may degrade in the presence of a hydrated organic or inorganic compound solid, which may be included in the screens 20, so that a source of water is available in the well when the screens are installed. For example, the hydrated organic or inorganic compound could be provided in the wire mesh of the drainage layers 38, 42. Alternatively, another water source, such as an aqueous solution, may be delivered to the sealing substance 32 after the screens 20 are conveyed into the well, such as by circulating the water source down to the screens.

Note that the sealing substance 32 may be degraded, thereby permitting fluid flow through the screen sidewall 34, either before or after the screens 20 are expanded in the wellbore 14. For example, formation water may be used as the water source to degrade the sealing substance after expansion of the screens 20.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of installing a well screen in a subterranean well, the method comprising the steps of:

providing the screen including a filtering layer with a temporary sealing substance impregnated in the filtering layer and preventing fluid flow through the filtering layer;

positioning the screen in a wellbore of the well;

expanding the screen in the wellbore; and degrading the sealing substance, thereby permitting fluid flow through the filtering layer, and the degrading step being performed after the expanding step.

2. The method according to claim 1, wherein the degrading step further comprises exposing the sealing substance to water in the wellbore.

3. The method according to claim 1, wherein the degrading step further comprises exposing the sealing substance to elevated temperature in the wellbore.

4. The method according to claim 1, wherein the providing step further comprises positioning the filtering layer between an outer shroud and an inner base pipe of the screen.

5. A method of installing a well screen in a subterranean well, the method comprising the steps of:

providing the screen including a filtering layer with a temporary sealing substance impregnated in the filtering layer and preventing fluid flow through the filtering layer, the sealing substance comprising a degradable polymer;

positioning the screen in a wellbore of the well;

expanding the screen in the wellbore; and degrading the sealing substance, thereby permitting fluid flow through the filtering layer.

6. The method according to claim 5, wherein the degradable polymer comprises a polysaccharide, chitin, chitosan, protein, aliphatic polyester, poly(lactide), poly(glycolide), poly(ϵ-caprolactone), poly(hydroxybutyrate), poly(anhydride), aliphatic polycarbonate, poly(orthoester), poly (amino acid), poly(ethylene oxide), or a polyphosphazene.

7. A method of installing a well screen in a subterranean well, the method comprising the steps of:

providing the screen including a filtering layer with a temporary sealing substance impregnated in the filtering layer and preventing fluid flow through the filtering layer, and the providing step further including providing the screen with a source of water in the form of a hydrated organic or inorganic solid compound;

positioning the screen in a wellbore of the well;

expanding the screen in the wellbore; and degrading the sealing substance, thereby permitting fluid flow through the filtering layer.

8. A method of installing a well screen in a subterranean well, the method comprising the steps of:

providing the screen including a temporary sealing substance preventing fluid flow through a wall of the screen, the temporary sealing substance comprising a polysaccharide, chitin, chitosan, protein, aliphatic polyester, poly(lactide), poly(glycolide), poly(ε-caprolactone), poly(hydroxybutyrate), poly(anhydride), aliphatic polycarbonate, poly(orthoester), poly(amino acid), poly(ethylene oxide), or a polyphosphazene;

conveying the screen into a wellbore of the well while the sealing substance prevents fluid flow through the screen wall;

circulating fluid through the screen while the sealing substance prevents fluid flow through the screen wall;

degrading the sealing substance, thereby permitting fluid flow through the screen wall; and expanding the screen in the wellbore.

9. The method according to claim 8, wherein the expanding step further comprises using an expander tool to expand the screen, and wherein the conveying step further comprises conveying the expander tool into the wellbore with the screen.

10. The method according to claim 8, wherein the expanding step is performed while the sealing substance prevents fluid flow through the screen wall.

11. The method according to claim 8, wherein the conveying and expanding steps are performed in a single trip into the well.

12. The method according to claim 8, wherein the degrading step is performed prior to the expanding step.

13. The method according to claim 8, wherein the degrading step is performed after the expanding step.

14. A method of installing a well screen in a subterranean well, the method comprising the steps of:

providing the screen including a temporary sealing substance preventing fluid flow through a wall of the screen, the temporary sealing substance comprising a polysaccharide, chitin, chitosan, protein, aliphatic polyester, poly(lactide), poly(glycolide), poly(ε-caprolactone), poly(hydroxybutyrate), poly(anhydride), aliphatic polycarbonate, poly(orthoester), poly(amino acid), poly(ethylene oxide), or a polyphosphazene;

conveying the screen into a wellbore of the well while the sealing substance prevents fluid flow through the screen wall;

circulating fluid through the screen while the sealing substance prevents fluid flow through the screen wall, the circulating step being performed prior to expanding the screen in the wellbore; and degrading the sealing substance, thereby permitting fluid flow through the screen wall.

15. The method according to claim 14, wherein the conveying, circulating and expanding steps are performed in a single trip into the well.

16. A method of installing a well screen in a subterranean well, the method comprising the steps of:

providing the screen including a temporary sealing substance preventing fluid flow through a wall of the screen, the temporary sealing substance comprising a polysaccharide, chitin, chitosan, protein, aliphatic polyester, poly(lactide), poly(glycolide), poly(ε-caprolactone), poly(hydroxybutyrate), poly(anhydride), aliphatic polycarbonate, poly(orthoester), poly(amino acid), poly(ethylene oxide), or a polyphosphazene;

conveying the screen into a wellbore of the well while the sealing substance prevents fluid flow through the screen wall;

circulating fluid through the screen while the sealing substance prevents fluid flow through the screen wall; and degrading the sealing substance, thereby permitting fluid flow through the screen wall, and wherein the providing step further comprises impregnating a filtering layer of the screen with the sealing substance, and positioning the filtering layer between an outer shroud and an inner base pipe of the screen.

17. A method of installing a well screen in a subterranean well, the method comprising the steps of:

providing the screen including a temporary sealing substance preventing fluid flow through a wall of the screen, the temporary sealing substance comprising a polysaccharide, chitin, chitosan, protein, aliphatic polyester, poly(lactide), poly(glycolide), poly(ε-caprolactone), poly(hydroxybutyrate), poly(anhydride), aliphatic polycarbonate, poly(orthoester), poly(amino acid), poly(ethylene oxide), or a polyphosphazene;

conveying the screen into a wellbore of the well while the sealing substance prevents fluid flow through the screen wall;

circulating fluid through the screen while the sealing substance prevents fluid flow through the screen wall; and degrading the sealing substance, thereby permitting fluid flow through the screen wall, and wherein the providing step further comprises providing the screen with a source of water in the form of a hydrated organic or inorganic solid compound.

18. An expandable well screen system, comprising a well screen including a filtering layer impregnated with a temporary sealing substance which prevents fluid from flowing through the filtering layer, the filtering layer being positioned between an outer shroud and an inner base pipe of the screen, and wherein the screen has an expanded configuration and an unexpanded configuration in a well.

19. The system according to claim 18, wherein the sealing substance comprises a plasticizer.

20. The system according to claim 18, wherein the sealing substance comprises poly(lactic acid).

21. The system according to claim 18, wherein the sealing substance comprises a stereoisomer of a poly(lactide).

22. The system according to claim 18, wherein the sealing substance comprises poly(phenyllactide).

23. The system according to claim 18, wherein the sealing substance comprises a degradable polymer.

24. The system according to claim 23, wherein the degradable polymer comprises a polysaccharide, chitin, chitosan, protein, aliphatic polyester, poly(lactide), poly(glycolide), poly(ε-caprolactone), poly(hydroxybutyrate), poly (anhydride), aliphatic polycarbonate, poly(orthoester), poly (amino acid), poly(ethylene oxide), or a polyphosphazene.

25. The system according to claim 18, further comprising an expander tool attached to the screen while the sealing substance prevents fluid flow through the filtering layer.

26. The system according to claim 25, wherein the expander tool expands the screen from the unexpanded configuration to the expanded configuration while the sealing substance prevents fluid flow through the filtering layer.

27. An expandable well screen system, comprising a well screen including a filtering layer impregnated with a temporary sealing substance which prevents fluid from flowing through the filtering layer, the sealing substance degrading when exposed to a water source in the well, and wherein the screen has an expanded configuration and an unexpanded configuration in a well.

28. The system according to claim 27, wherein the water source is included in the screen.

29. The system according to claim 28, wherein the water source comprises a hydrated organic or inorganic compound.

30. The system according to claim 27, wherein the water source is present in the well prior to positioning the screen in the well.

31. The system according to claim 27, wherein the water source is introduced into the well after positioning the screen in the well.

* * * * *